US010596055B1

(12) United States Patent
Fernandez et al.

(10) Patent No.: US 10,596,055 B1
(45) Date of Patent: Mar. 24, 2020

(54) REUSABLE TRANSPARENT CASKET ASSEMBLY

(71) Applicants: Rangel Fernandez, Doral, FL (US); Andrea Fernandez, Doral, FL (US)

(72) Inventors: Rangel Fernandez, Doral, FL (US); Andrea Fernandez, Doral, FL (US)

( * ) Notice: Subject to any disclaimer, the term of this patent is extended or adjusted under 35 U.S.C. 154(b) by 0 days.

(21) Appl. No.: 16/274,658

(22) Filed: Feb. 13, 2019

(51) Int. Cl.
*A61G 17/00* (2006.01)
*A61G 17/04* (2006.01)
*A61G 17/007* (2006.01)

(52) U.S. Cl.
CPC ..... *A61G 17/001* (2017.05); *A61G 17/0073* (2013.01); *A61G 17/0136* (2017.05); *A61G 17/0166* (2017.05); *A61G 17/0405* (2017.05)

(58) Field of Classification Search
CPC ..... A61G 17/001; A61G 17/0136; A61G 17/0405; A61G 17/0073; A61G 17/0166; A61G 17/004
USPC ..... 27/2, 8, 35
See application file for complete search history.

(56) References Cited

U.S. PATENT DOCUMENTS 1,260,927 A 3/1918 McKinney
1,454,427 A 5/1923 Cunning
2,111,275 A * 3/1938 Blower ..... A61G 17/00 27/35
2,159,144 A 5/1939 Fletcher
D138,497 S 8/1944 Schmidt
2,579,756 A 12/1951 Reed
2,907,090 A * 10/1959 Gaspardo ..... A61G 17/00 27/8
3,133,334 A * 5/1964 Johnsen ..... A61G 17/02 27/27
3,815,185 A 6/1974 Owens
5,301,398 A 4/1994 Bursey, Jr.
5,481,785 A 1/1996 Minton et al.
5,592,723 A * 1/1997 Leijonhufvud ..... A61G 17/00 27/2
D408,114 S 4/1999 Poitier et al.
5,956,825 A * 9/1999 McCoy ..... A61G 17/00 27/2
6,385,824 B1 5/2002 Schwartz
6,684,467 B1 * 2/2004 Walker ..... A61G 17/00 27/35
7,302,743 B2 12/2007 Fash
7,475,458 B1 * 1/2009 Gordon ..... A61G 17/02 27/35
8,127,414 B2 * 3/2012 Rankin ..... A61G 17/02 27/27
8,601,653 B1 12/2013 Agurcia et al.
(Continued)

*Primary Examiner* — William L Miller
(74) *Attorney, Agent, or Firm* — Robert M. Downey, P.A.

(57) ABSTRACT

A casket assembly includes a floor structure, transparent side walls and end walls extending upwardly from a lower rail to define side panels and end panels, and a transparent lid attached to at least one of the side walls. A cardboard insert container made of a material suitable for cremation is sized for receipt within the enclosed casket interior. At least one of the side panels or end panels is movable between a closed position to completely enclose the casket interior and an open position to allow horizontal movement of the insert container holding a deceased human body into and out from the casket interior without having to lift the insert container over the top edge of the side and end panels.

11 Claims, 14 Drawing Sheets

(56) References Cited

U.S. PATENT DOCUMENTS

| | | | | |
|---|---|---|---|---|
| 8,914,953 | B1 | 12/2014 | Thacker | |
| 2010/0218351 | A1* | 9/2010 | Rankin | A61G 17/02 27/17 |
| 2013/0160258 | A1* | 6/2013 | Davis | A61G 17/0073 27/2 |
| 2015/0149367 | A1* | 5/2015 | Thacker | G06Q 30/0645 705/307 |
| 2016/0008202 | A1* | 1/2016 | Davis | E05D 5/046 27/10 |
| 2016/0228318 | A1* | 8/2016 | Hoijng | A61G 17/02 |

* cited by examiner

REUSABLE TRANSPARENT CASKET ASSEMBLY

BACKGROUND OF THE INVENTION

Field of the Invention

The present invention relates to a transparent, clear or translucent casket assembly and, more particularly, to a transparent, clear or translucent reusable casket assembly that is adapted to allow for placement and removal of a deceased human body in a cremation container into and out from the casket assembly.

Discussion of the Related Art

When a loved one passes away, it is common to have a viewing ceremony followed by a funeral service. At the viewing ceremony, the deceased is presented in a casket which, in many instances, is made of wood or metal. In order to allow family members and friends to view the deceased and say their final goodbyes, the lid of the casket is held open. However, some people are not comfortable approaching an open casket with the deceased body fully exposed. Others, on the contrary, would prefer more visibility even from a distance. A transparent casket provides an effective solution for this situation and allows the lid to remain closed while still presenting the deceased for the viewing ceremony. In other instances, a celebrity, a VIP, a government official, public servant officer or agent from any branch of the military, state or local officer and even the common individual can now benefit from a highly visible funeral ceremony in which it is intended, desired, or customary to have such high visibility even at a distance. Other benefits of a transparent casket include the ability to have a "closed casket" service in case of a violent death which causes mutilation and/or disfiguration of the face and body. Under these circumstances, the deceased's body can be manipulated and corrected by a professional embalmer without the need to have family or friends access the deceased at close range proximity. Furthermore, the transparent casket can remain closed to avoid unpleasant gases or odors spreading throughout the visitation room while still having full visibility of the body. This applies in cases in which the funeral home does not utilize embalming fluids or inadequate embalming fluids. In other cases, it has been stated that persons who suffered from contagious deadly deceases, such as bacterial infections or viruses, could be viewed closely while the transparent casket is shut.

The cost of a casket can vary depending on the material of the casket, the level of quality of construction, as well as the level of quality and ornamentation of interior and exterior finishes and hardware. A transparent casket made of poly(methyl methacrylate), also known as acrylic or acrylic glass, can be considered from moderate to high cost, particularly if the transparent casket is requested as a custom-made order (particular dimension/size and or special translucent acrylic color. It can also increase price if added decorations are requested or if a fine metal hardware is requested, such as bronze or gold. Otherwise the standard proposal offered is functional and elegant at an affordable price to the average family in both options; burial or viewing prior to cremation. In many instances, a more expensive casket may only be needed for the viewing ceremony and funeral service. In the event the deceased is to be cremated, the deceased body will be removed from the casket after the funeral service and all that additional expense in the look of the casket would go to waste. This transparent casket is both hygienic, multifunctional and versatile. Even if the deceased is to be buried, some families may choose to have the deceased body removed from a more expensive casket and placed into a less expensive casket for burial. Under these circumstances, the family may choose to rent the more expensive ornamental casket for temporary use during the viewing ceremony and funeral service to then incur additional unnecessary expenses.

Another potential use of the transparent casket can be found in the science, research, medical or clinical forensic fields, in which the preservation of bodies including freezing techniques or incubation chambers bring added value when able to identify, see, study and analyze the deceased bodies through the casket without the need to open the lids if need be.

The present invention provides a highly ornamental and functional transparent casket that is reusable and which can be thus rented to the family of the deceased in instances where the deceased's body is going to be removed from the casket after the funeral service. The transparent reusable casket of the present invention is particularly suited for situations where the deceased is going to be cremated after a viewing ceremony and funeral service. Moreover, the transparent reusable casket of the present invention allows for easier and more convenient movement of the deceased's body and a cremation insert container or tray into and out of the casket without having to lift the body and cremation insert over the side wall structure of the casket.

SUMMARY OF THE INVENTION

The present invention is directed to a reusable transparent casket assembly which is further enhanced by the installation of LED lighting within the base structure of the casket offered in a variety of alternating colors and intensity shades. The casket assembly includes a floor structure, transparent side walls and end walls extending upwardly from a lower rail to define side panels and end panels, and a transparent lid attached to at least one of the side walls. An insert container made of a material suitable for cremation is sized for receipt within the enclosed casket interior. At least one of the side panels or end panels is movable between a closed position to completely enclose the casket interior and an open position to allow horizontal movement of the insert container holding a deceased human body into and out from the casket interior without having to lift the insert container over the top edge of the side and end panels. In several embodiments of the invention, the entire constructed casket box structure comprising the side panels, end panels and lid is removable and separable from the floor structure. In another embodiment, the casket box structure is hinged to the floor structure and is capable of being tilted open to allow placement and removal of a cremation insert tray and deceased body from the floor structure. In another embodiment, the foot panel (i.e., end panel) is hinged to the floor structure and is able to swing out and drop down to allow unobstructed placement and removal of the cremation insert tray and deceased body into and out from the casket interior.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 7:
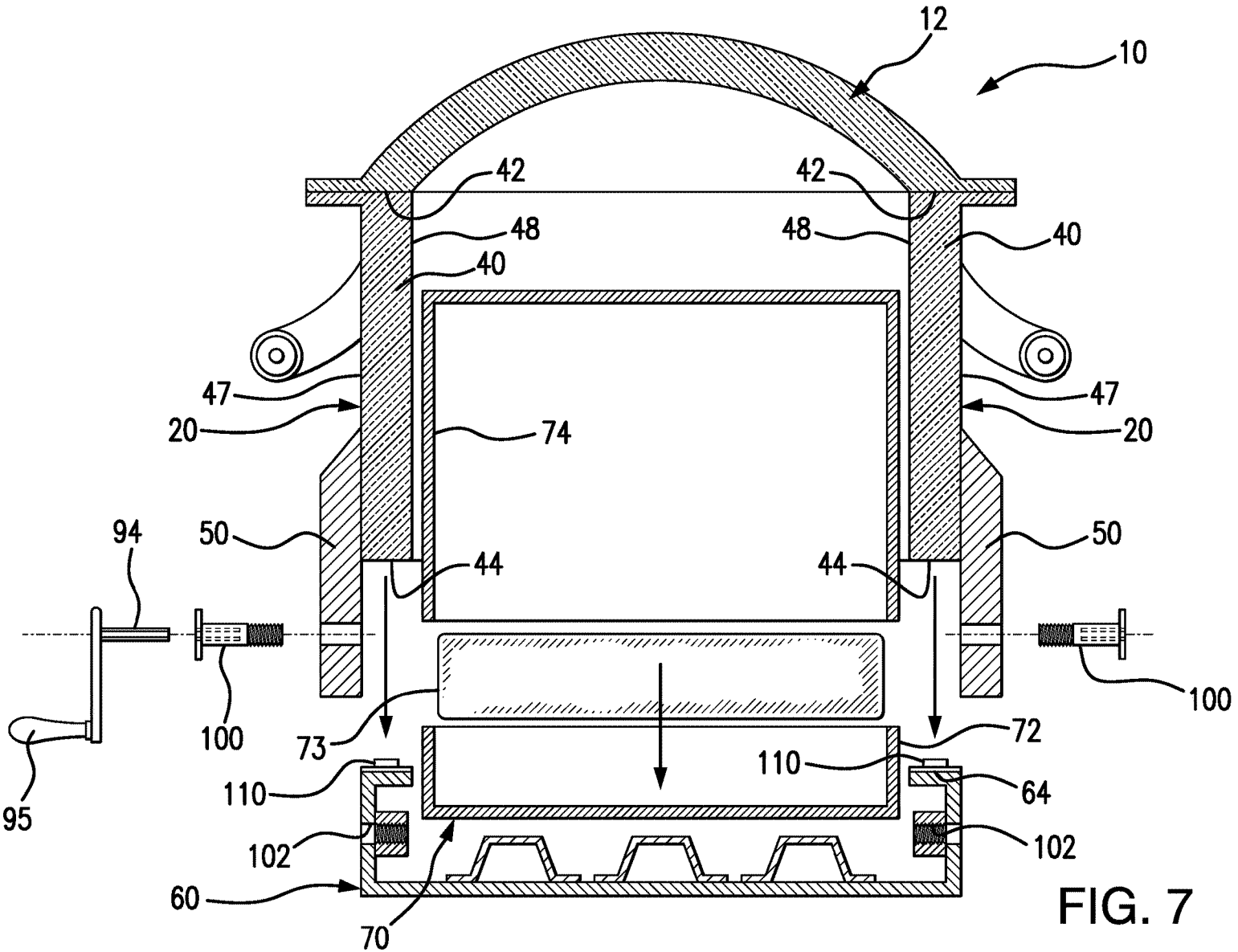
FIG. 7 is an exploded end elevational view, shown in cross-section, illustrating a second embodiment of the reusable transparent casket assembly of the present invention.
Figure 8:
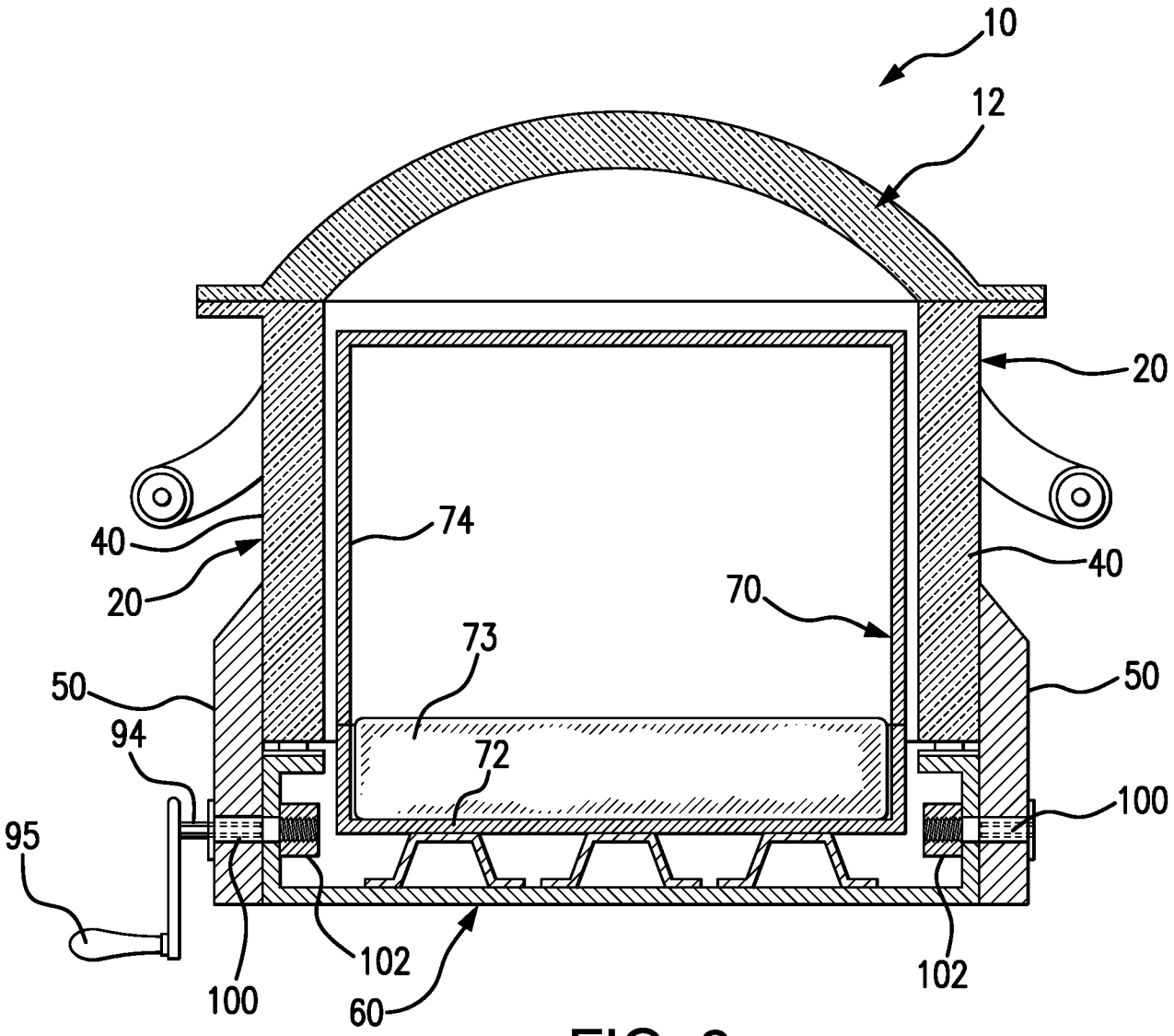
FIG. 8 is an end elevational view, shown in cross-section, showing the reusable transparent casket assembly of FIG. 7 fully assembled with the casket panel assembly secured to the floor structure and a cremation insert within an enclosed interior of the casket.
Figure 10:
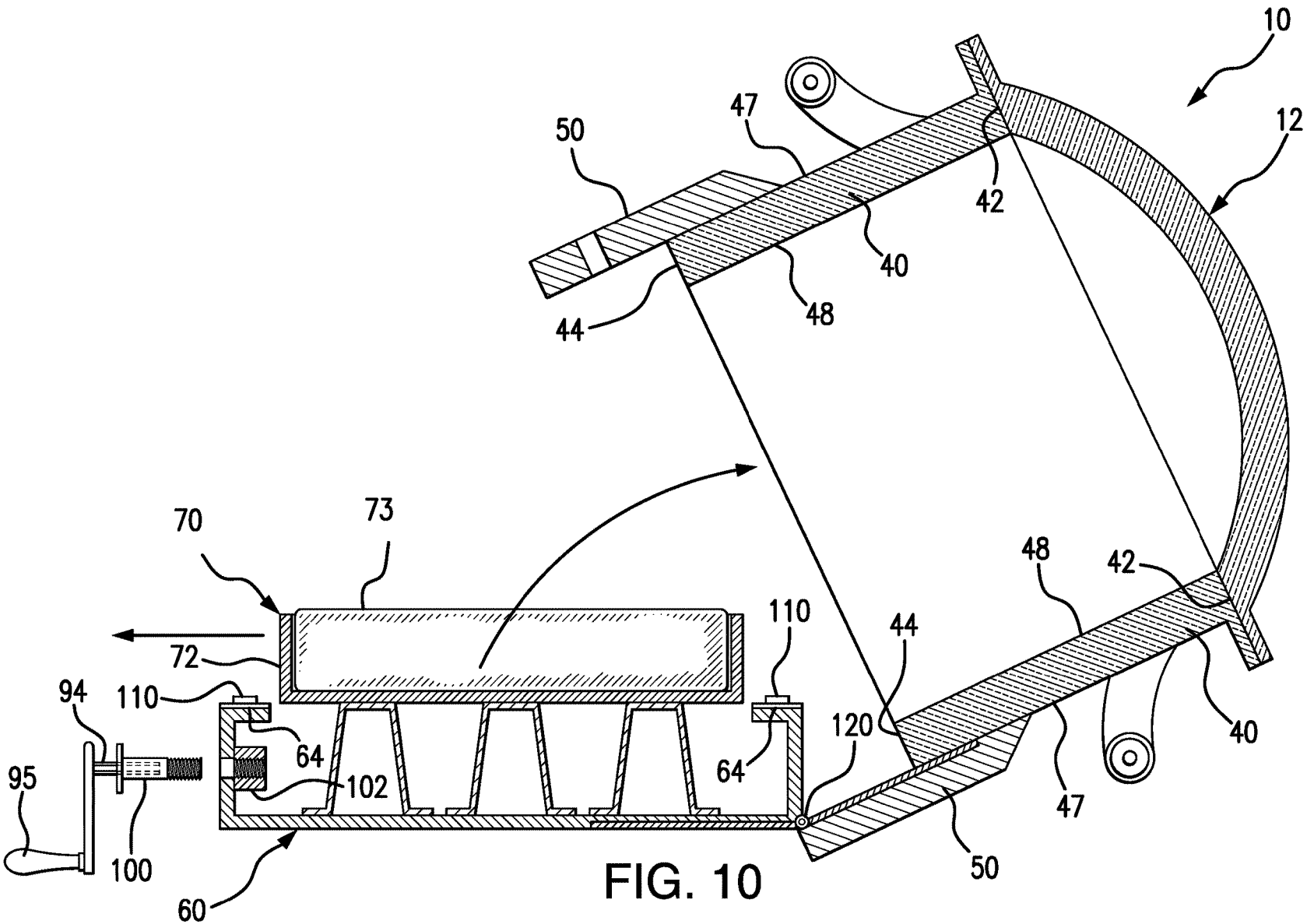
FIG. 10 is an end elevational view, shown in cross section, showing the reusable transparent casket assembly of the embodiment of FIG. 9, wherein the entire side panel and lid structure of the casket assembly is shown hinged open relative to the floor structure to allow placement and removal of the cremation insert, as well as a deceased human body, within the casket interior for support on the floor structure.

Referring to the several views of the drawings, and initially FIGS. 1 through 6, the reusable transparent casket assembly of the present invention is shown and is generally indicated as 10, in accordance with a first embodiment thereof. The transparent casket assembly 10 includes a transparent lid 12 that may be split into two separate sections 12*a*, 12*b*. The transparent casket assembly 10 further includes longitudinal side panels 20 and transverse end panels 30, including a head panel 30*a* and a foot panel 30*b*. The side panels 20 and end panels 30 each include a transparent wall 40 having a top edge 42, a bottom edge 44, opposite vertical side edges 46, an outer surface 47 and an inner surface 48. In a preferred embodiment, the transparent lid 12 and transparent walls 40 are formed of poly(methyl methacrylate), referred to hereinafter as acrylic. The side panels 20 and end panels 30 further include a lower rail 50 attached to a lower portion of the outer surface 47 of the transparent walls 40 and extending downwardly below the bottom edge 44 of the walls 40. The lower rail 50 may be formed of metal, wood or other material that provides strength and rigidity to the box structure formed by the side panels 20 and end panels 30. The casket assembly 10 also includes a floor structure 60 that is secured to the bottom portion of the side panels 20. When fully constructed and assembled, the lid 12, side panels 20, opposite end panels 30 and floor structure 60 surround and enclose a casket interior for holding a deceased human body. According to the several embodiments of the present invention, the floor structure 60 and casket interior are particularly sized, structured and configured for holding a cremation insert container 70 along with a deceased human body placed within the insert container. The cremation insert container 70 includes a bottom tray 72 for placement of the deceased body thereon. The bottom tray 72 may be fitted with a lining 73 or decorative padding, as seen in FIGS. 7, 8 and 10. Any decorative lining or padding would most likely be temporarily used during a viewing ceremony and funeral service and then removed therefrom prior to cremation of the insert container and deceased's body. As seen in FIG. 7, the cremation insert 70 typically includes a cover 74 that is normally placed onto the bottom tray 72 once the tray and deceased's body is removed from the casket for delivery to the crematorium.

In each of the embodiments shown throughout the several views of the drawings, the transparent reusable casket assembly 10 is specifically structured to allow for ease of placement and removal of the cremation insert container 70 and deceased's body into and out of the casket without having the lift the body and insert container over the top edge of the side panels. In several embodiments of the invention, as shown in FIGS. 1 through 8, the casket assembly 10 is structured to allow for lifting of the entire casket box structure comprising the side panels 20, opposite end panels 30 and lid 12 off of the floor structure. In other words, the side panels 20, end panels 30 and lid 12 remain intact as an assembled box structure that can be completely separated from the floor structure 60. This allows the insert container 70 and deceased's body to be easily placed on the floor structure 60 in a horizontal movement with no obstructions. Once in proper position, the upper box structure comprising the assembled side panels 20, end panels 30 and lid 12 can be lowered down onto the floor structure 60, around the insert container and deceased's body and then fastened to the floor structure. Similarly, to remove the insert container 70 and deceased's body, the assembled upper box structure is lifted from the floor structure 60 and completely separated therefrom so that the insert container 70 and body can be easily moved horizontally without having to lift the insert container and body up over the top edge 42 of the side panels 20.

Figure 1:
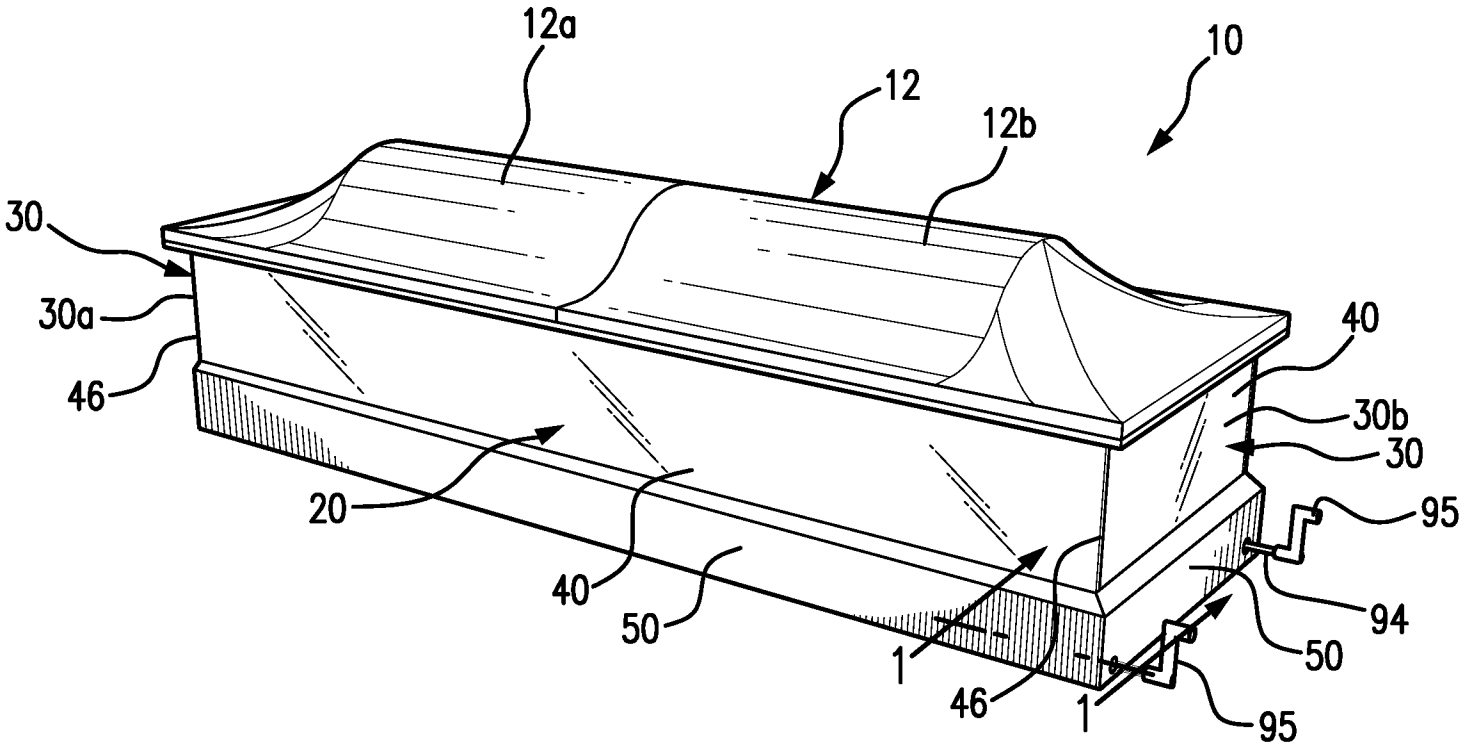
FIG. 1 is a front, top perspective view of the reusable transparent casket in accordance with one embodiment of the invention.
Figure 2:
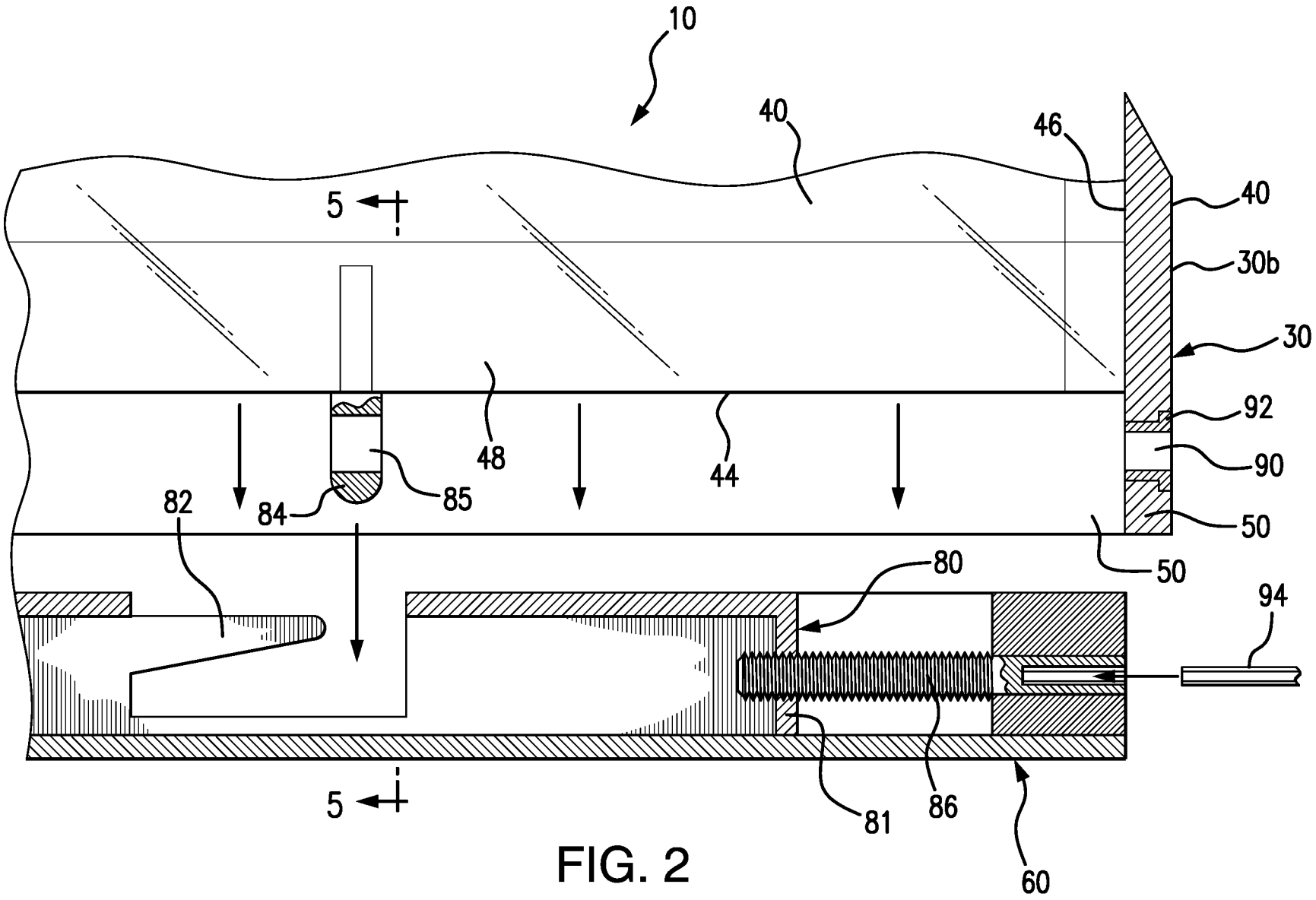
FIG. 2 is an isolated cross-sectional view taken along the plane of the line indicated as 1-1 in FIG. 1, wherein the casket panel assembly is shown separated from the floor structure, with arrows indicating lowering of the casket panel assembly downwardly towards the floor structure.
Figure 3:
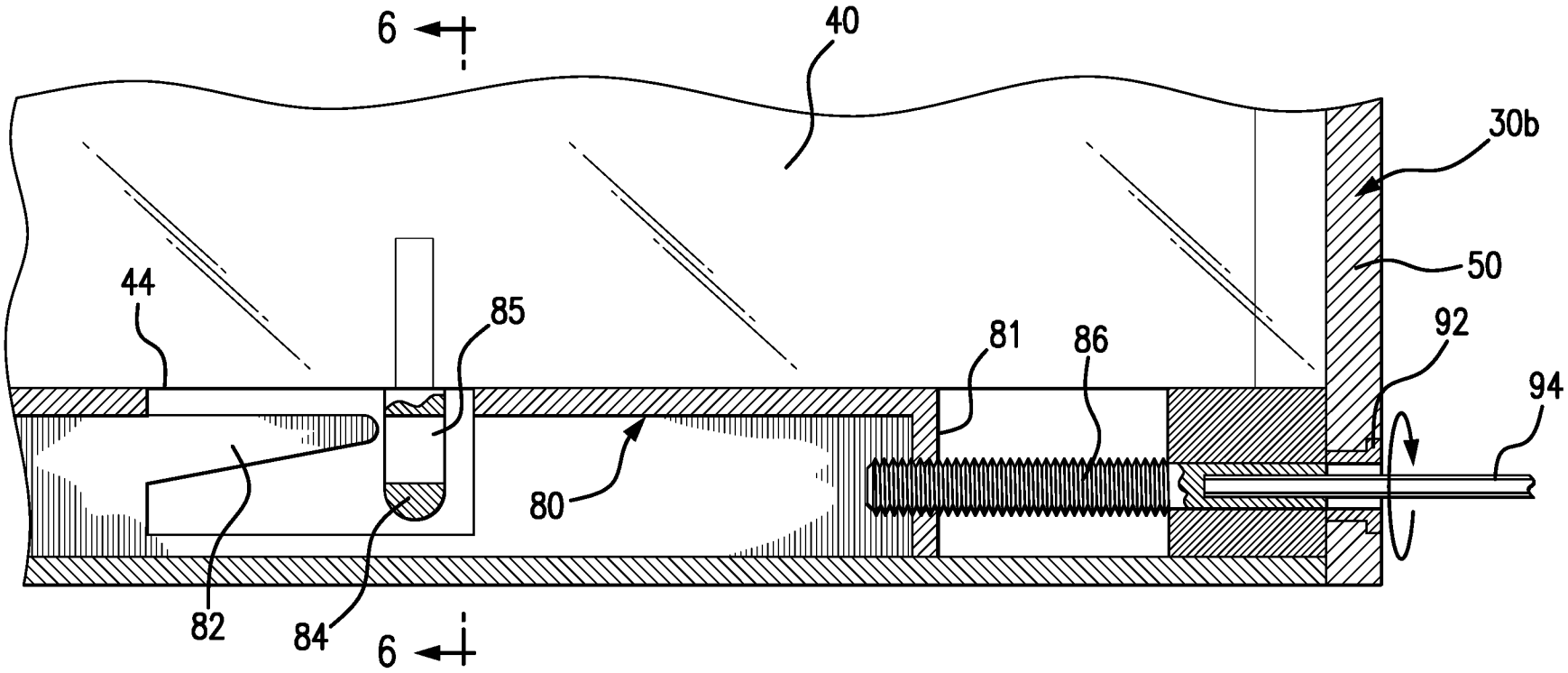
FIG. 3 is an isolated cross-sectional view taken along the plane indicated by the arrows 1-1 in FIG. 1, wherein the casket side panel assembly has been lowered onto the floor structure.
Figure 4:
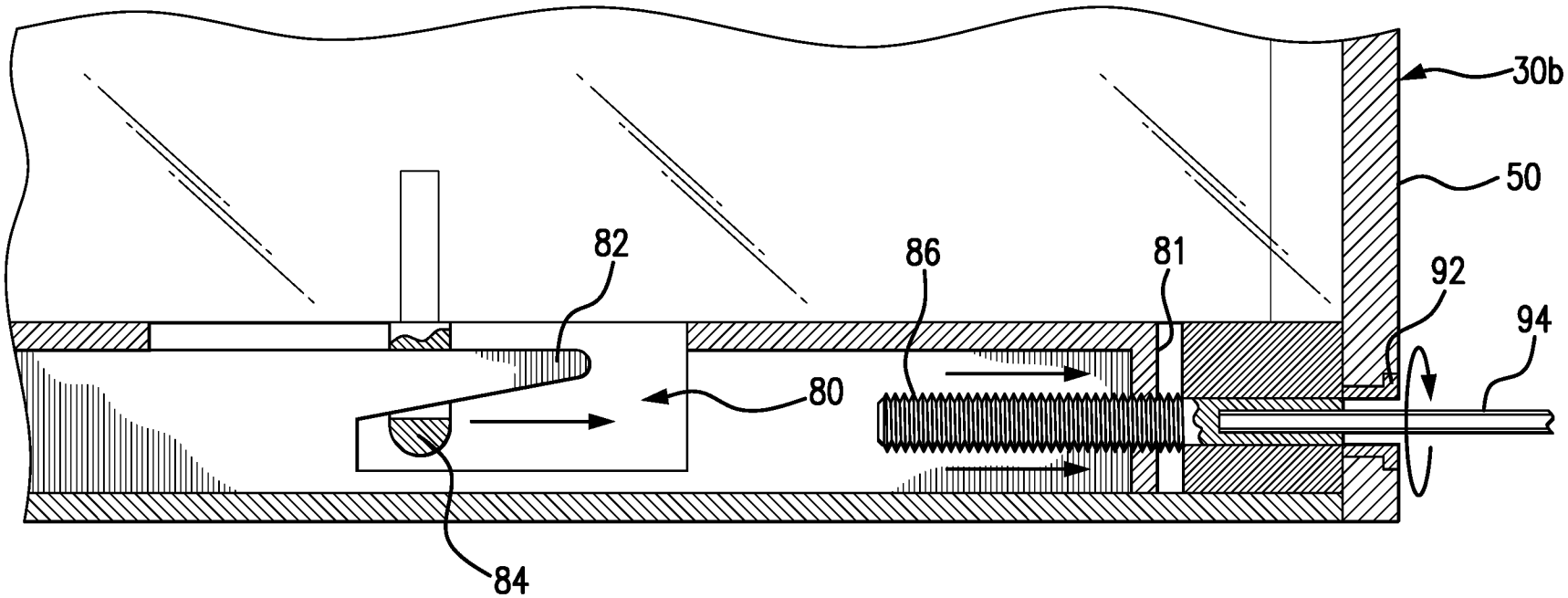
FIG. 4 is an isolated cross-sectional view taken along the plane indicated by the arrows 1-1 in FIG. 1, wherein a locking mechanism is shown engaged with one of a plurality of locking pins extending down from a bottom edge of the panel assembly to effectively lock the casket panel assembly onto the floor structure.
Figure 5:
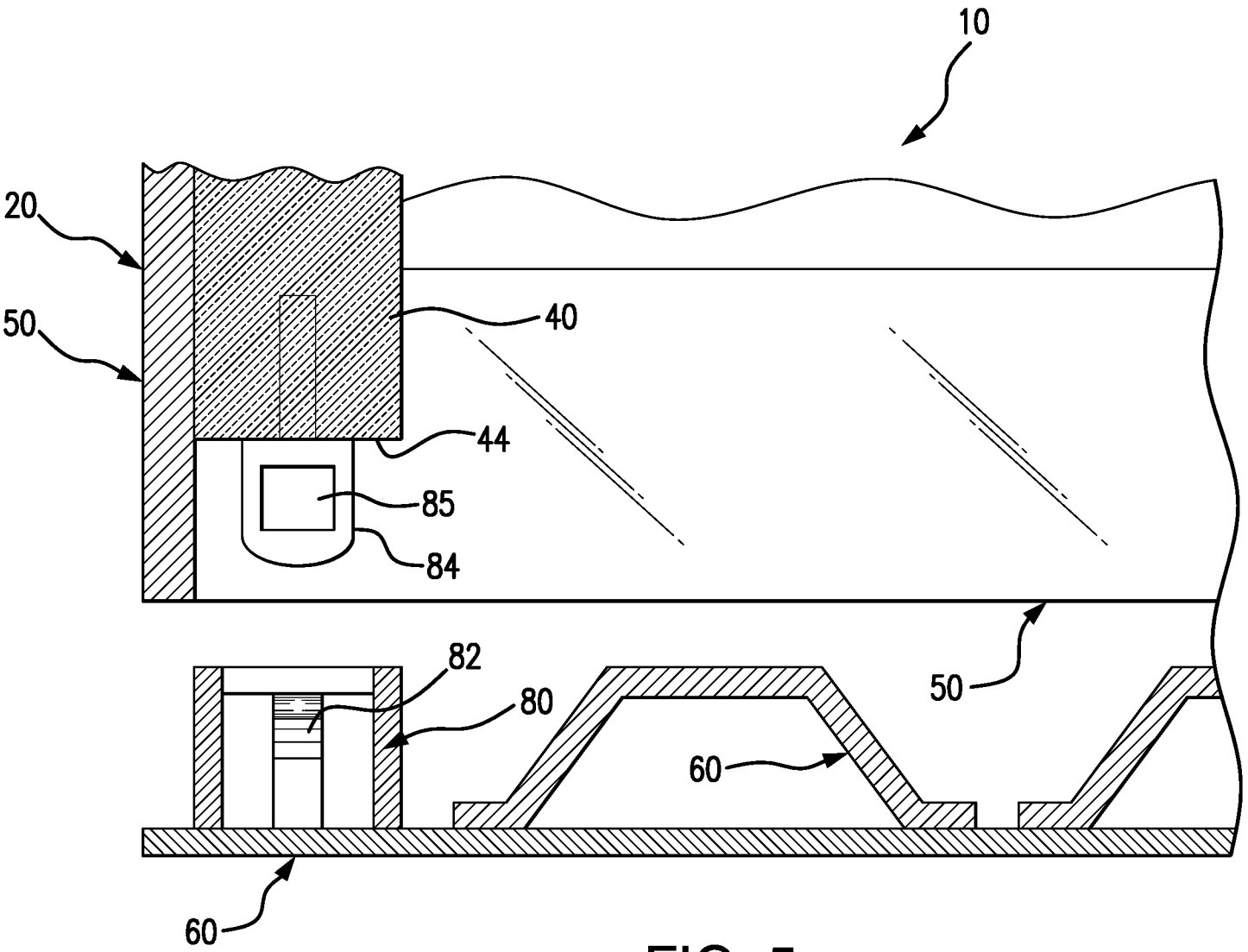
FIG. 5 is an isolated cross-sectional view taken along the line indicated as 5-5 in FIG. 2.
Figure 6:
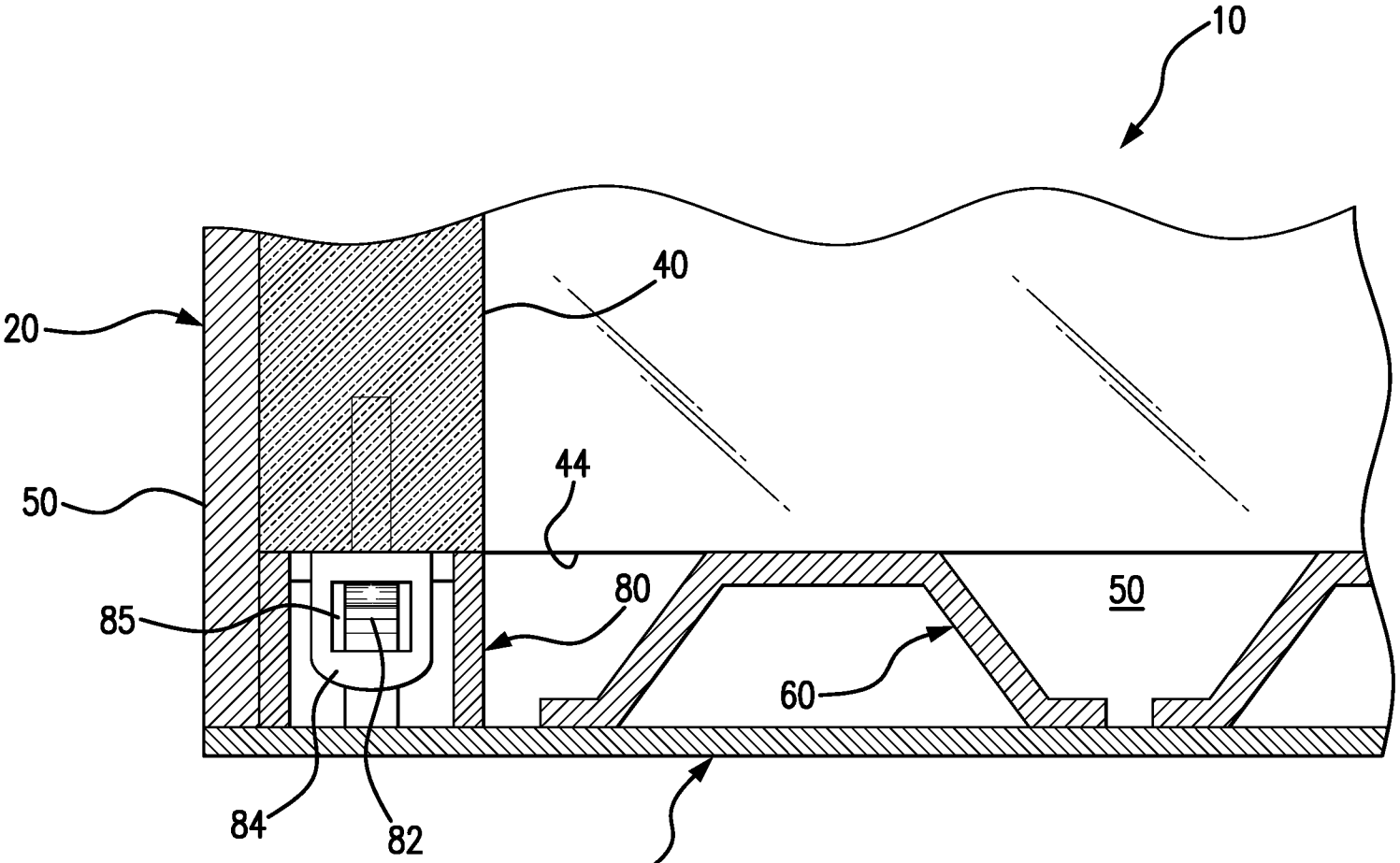
FIG. 6 is an isolated cross-sectional view taken along the line indicated as 6-6 in FIG. 3.

In the first embodiment, shown in FIGS. 1 through 6, the assembled upper box structure of the casket assembly is secured to the floor structure 60 with the use of a movable locking mechanism 80 that engages and disengages a plurality of locking fingers 82 within correspondingly aligned locking pins 84. More specifically, a longitudinally movable locking mechanism is fitted within the floor structure and includes a spaced arrangement of locking fingers 82 along its length. The locking mechanism 80 is moved by rotation of a threaded rod 86 that engages an end 81 of the movable locking mechanism 80. The rod 86 is accessible through an opening 90 at the end of the casket, such as the foot panel 30*b*. As seen in FIGS. 2-4, the lower rail 50 on the foot panel 30*b* is fitted with a bushing 92 that aligns with the end of the threaded rod 86. The end of the threaded rod 86 is specifically structured to receive a tool 94, such as a hex key or multisided bar extending from a crank lever 95. The tool 94 is inserted in the end of the threaded rod 86 and is rotated to turn the threaded rod so that the threaded engagement of the rod 86 with the locking mechanism 80 causes longitudinal movement of the locking mechanism, including the locking fingers 82, as shown by the arrows in FIG. 4. Reverse rotation of the tool 94 and threaded rod 86 serves to drive movement of the locking mechanism 80 in the opposite direction to release the locking fingers 82 from the locking pins 84. The locking pins 84, as seen in FIGS. 2-4, are fitted to the bottom edge 44 of the transparent walls 40 of the side panels 20 and include an enlarged head that extends down below the bottom edge of the walls. The enlarged head includes an aperture 85 for receipt of the locking finger 82 therein, as seen in FIG. 4. With the locking fingers 82 received within the apertures 85 of the correspondingly aligned locking pins 84, the upper box structure of the casket is effectively locked to the floor structure 60. In order to remove the upper box structure, comprising the side panels 20, end panels 30 and lid 12, from the floor structure 60, the threaded rod 86 is rotated in the opposite direction (opposite to that illustrated in FIG. 4) to move the locking mechanism 80 and effectively withdraw the locking fingers 82 from the apertures 85 of the locking pins 84, thereby allowing the upper box structure to be lifted and separated from the floor structure 60, as seen in FIGS. 2 and 5.

Figure 9:
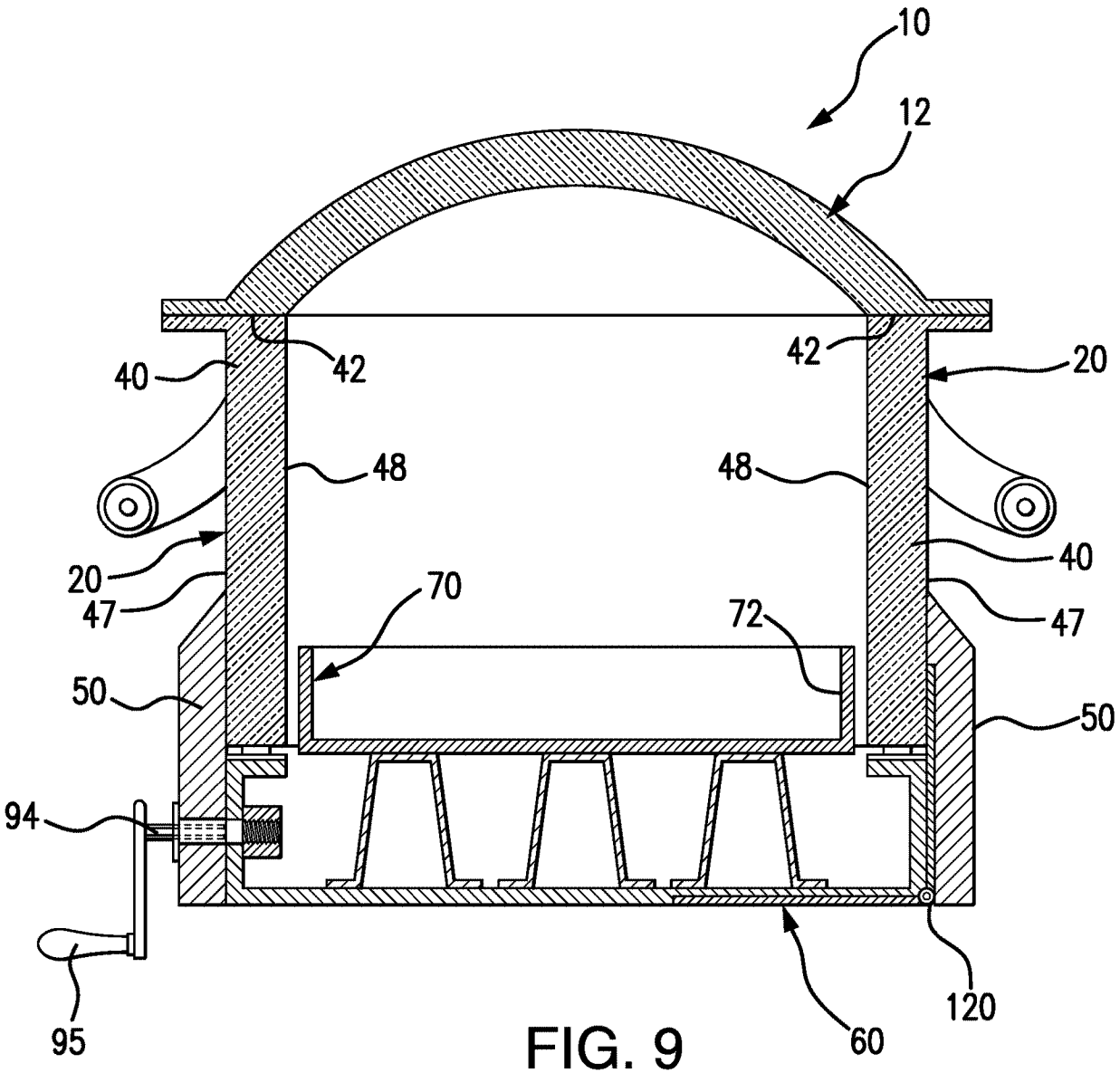
FIG. 9 is an end elevational view, shown in cross-section, illustrating a third embodiment of the reusable casket assembly of the present invention.

Referring to FIGS. 7 and 8, another embodiment of the casket assembly 10 is shown wherein the assembled box structure comprising the side panels 20, end panels 30 and lid 12 are removably attachable to the floor structure 60 with bolts 100 or similar fastening hardware that passes through the lower side rails 50 of the side panels 20 and into threaded bushings 102 within the floor structure 60. Similar to the first embodiment, as described above, the entire assembled upper box structure can be lifted off of the floor structure 60 to allow for ease of placement and removal of the casket insert container 70 and deceased body onto the floor structure 60. A hex key or similar tool 94, as described above, can be used to tighten and loosen the bolts 100. FIGS. 7 and 8 further show a full assembly of the insert container 70 including a lower tray portion 72 which may be fitted with the lining or padding 73, as well as a top portion 74 that covers the deceased body for transport when removed from the casket. A further feature of the present invention, shown in FIGS. 7 and 8, as well as FIGS. 9 and 10, is an illumination system for illuminating the transparent walls and lid of the casket. Specifically, an arrangement of LED lights 110 are positioned along a top edge 64 of the floor structure 60 for alignment with the bottom edges 44 of the transparent walls 40. The LEDs 110 may emit light color or any of a variety of colors, including changing colors. The light emitted from the LEDs 110 is directed up through the transparent walls 40 and through the lid 12 creating a illuminating or glowing effect. A power source (not shown) such as an AC power cord (for connection to an outlet) or batteries, may be installed within the floor structure 60, along with a switch and circuitry for actuating the LEDs 110.

In the embodiment shown in FIGS. 9 and 10, the entire assembled upper box structure of the casket assembly is movable relative to the floor structure 60 on a hinge 120 that attaches to one of the side panels 20 as well as the floor structure 60. Similar to the embodiment of FIGS. 7 and 8, bolts 100 or like fastening hardware can be used to completely secure the assembled upper box structure of the casket to the floor structure, with two or more bolts 100 passing through the lower side rail 50 and into a threaded bushing 102 within the floor structure 60. In order to place and remove the insert container 70, which in this case is the lower tray 72, the bolts 100 are removed, as shown in FIG. 10, thereby allowing the assembled upper box structure of the casket to be tilted on the hinge 120, as indicated by the arrow in FIG. 10. This allows for ease of horizontal movement of the insert container 70 and deceased body into and out of the casket for support on the floor structure 60.

Figure 12:
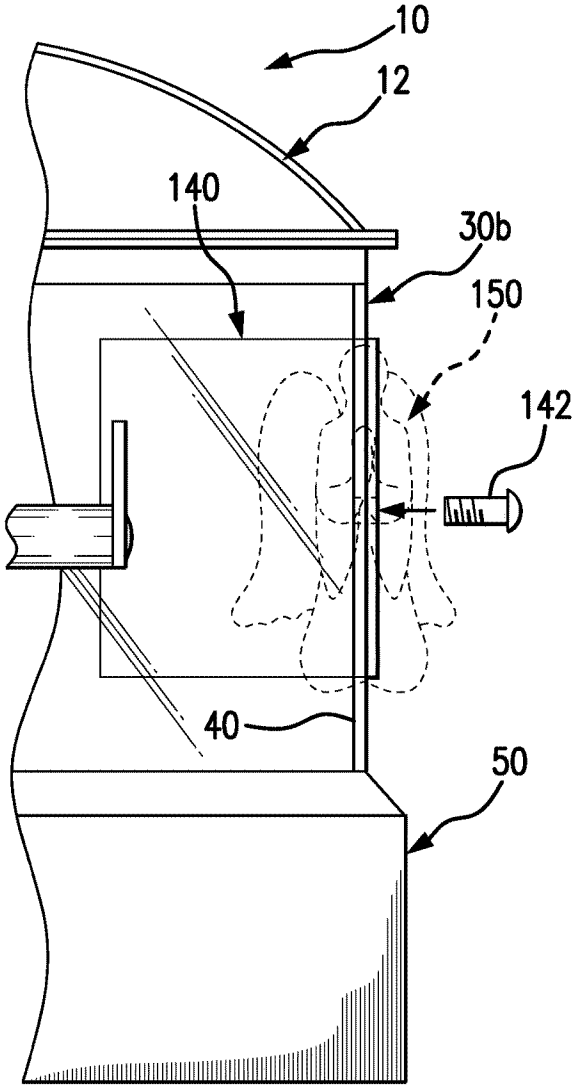
FIG. 12 is an isolated end elevational view showing the foot end of the casket in accordance with the embodiment of FIG. 11, with a securing bolt being inserted to hold the foot end panel closed.
Figure 11:
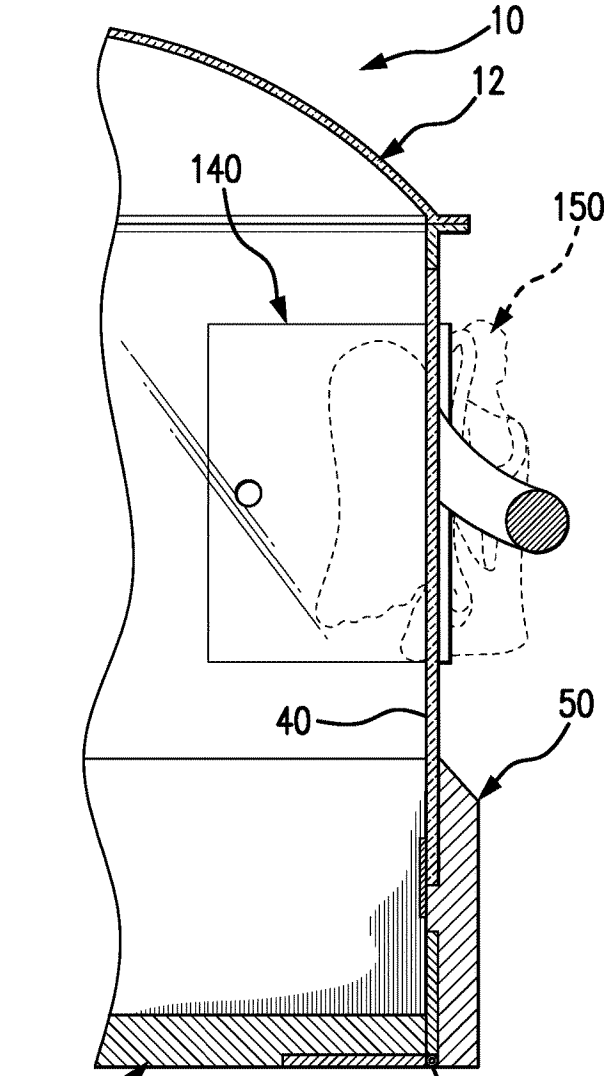
FIG. 11 is an isolated cross-sectional view of the foot end of the casket, showing a fourth embodiment of the transparent reusable casket assembly of the present invention.
Figure 13:
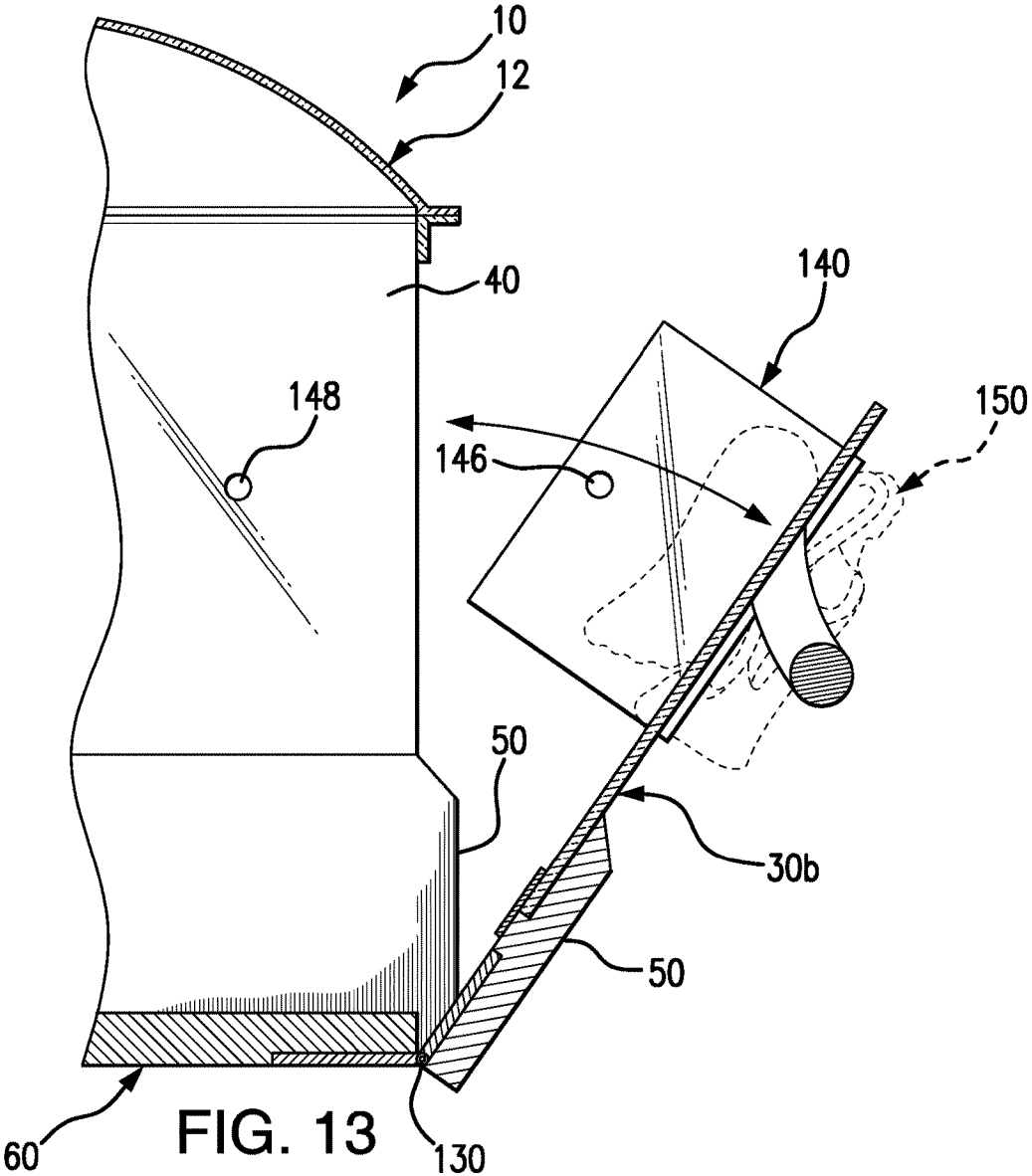
FIG. 13 is an isolated cross-sectional view showing the foot end of the casket in accordance with the embodiment of FIG. 11, wherein the foot end panel is shown hinged partially open and being movable between a fully open position and a closed position, as indicated by the arrows, to allow horizontal insertion and removal of the cremation insert and a deceased human body through the foot end of the casket.

FIGS. 11-13 show another embodiment of the invention wherein one of the end panels 30, and preferably the foot panel 30*b*, is hinged to the floor structure 60 to allow swinging, hinged movement of the foot panel 30*b* between a closed position, as shown in FIGS. 11 and 12, and an open position, as demonstrated by the arrow in FIG. 13. As seen in FIGS. 11 and 13, a hinge 130 attaches to both the floor structure 60 and the inside bottom rail 50 of the foot panel 30*b*. The transparent wall 40 of the foot panel 30*b* is fitted with an L-shaped bracket 140, which may be transparent as well. The L-shaped bracket 140 is designed to be received along the outside surface of the side wall 40 on each side of the casket when the foot panel 30*b* is closed. A bolt 142 or similar fastener, as seen in FIG. 12, passes through an aperture 146 in the L-shaped bracket and into the side wall of the casket which may be fitted with a threaded bushing 148. Decorative corner hardware 150 may be attached to the L-shaped bracket 140 with the bolt passing though the decorative hardware and bracket, thereby avoiding having to remove the decorative hardware when opening and closing the foot panel.

Figure 14:
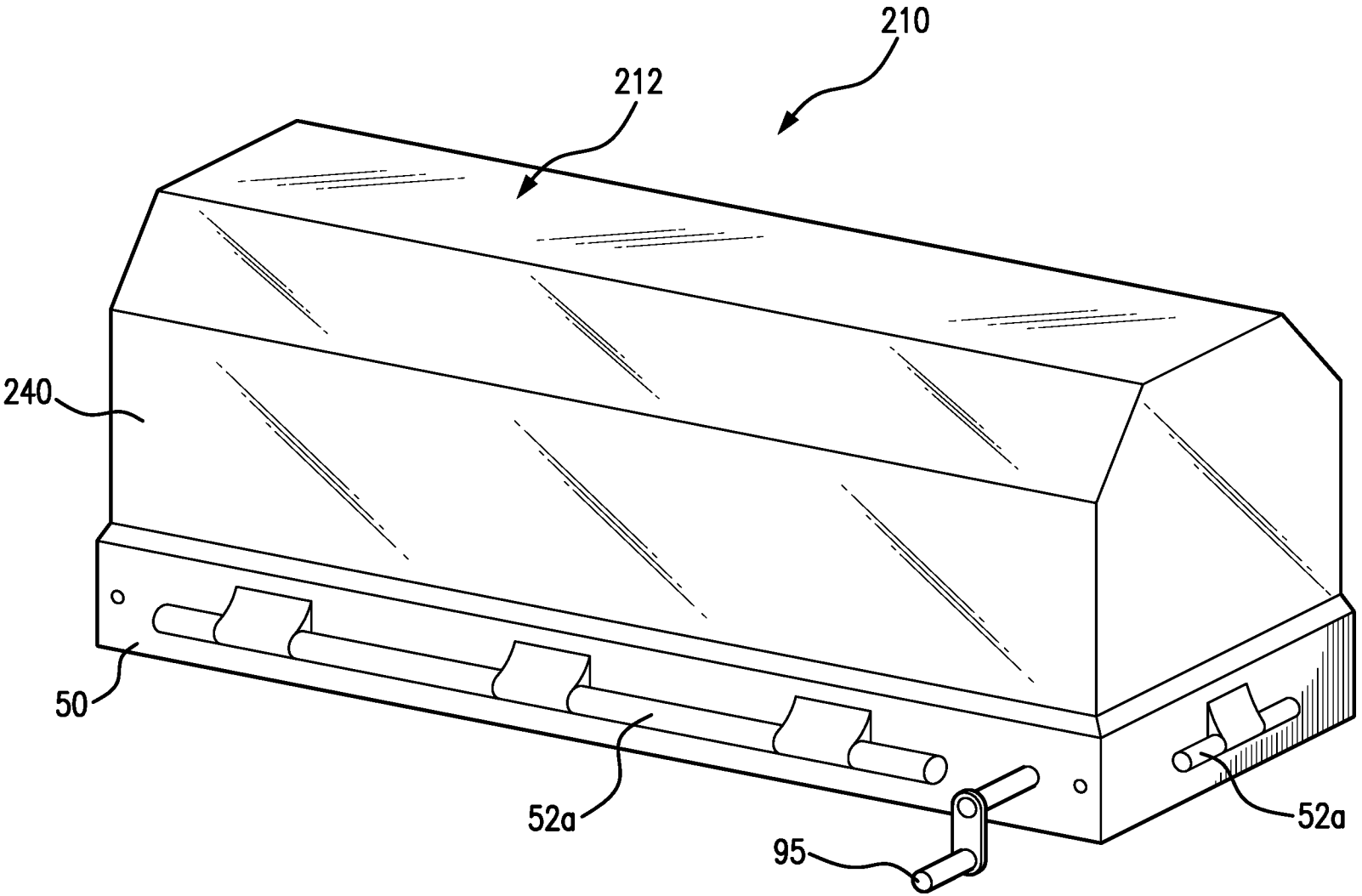
FIG. 14 is a perspective view of a further embodiment of the reusable transparent casket assembly of the present invention, wherein the top, side panels, head panel and foot panel are made as an integral unit including a transparent top, transparent side walls, a transparent head panel, and a transparent foot panel along with lower rails formed of wood or metal, and wherein the entire upper assembly is removable from a floor structure.
Figure 15:
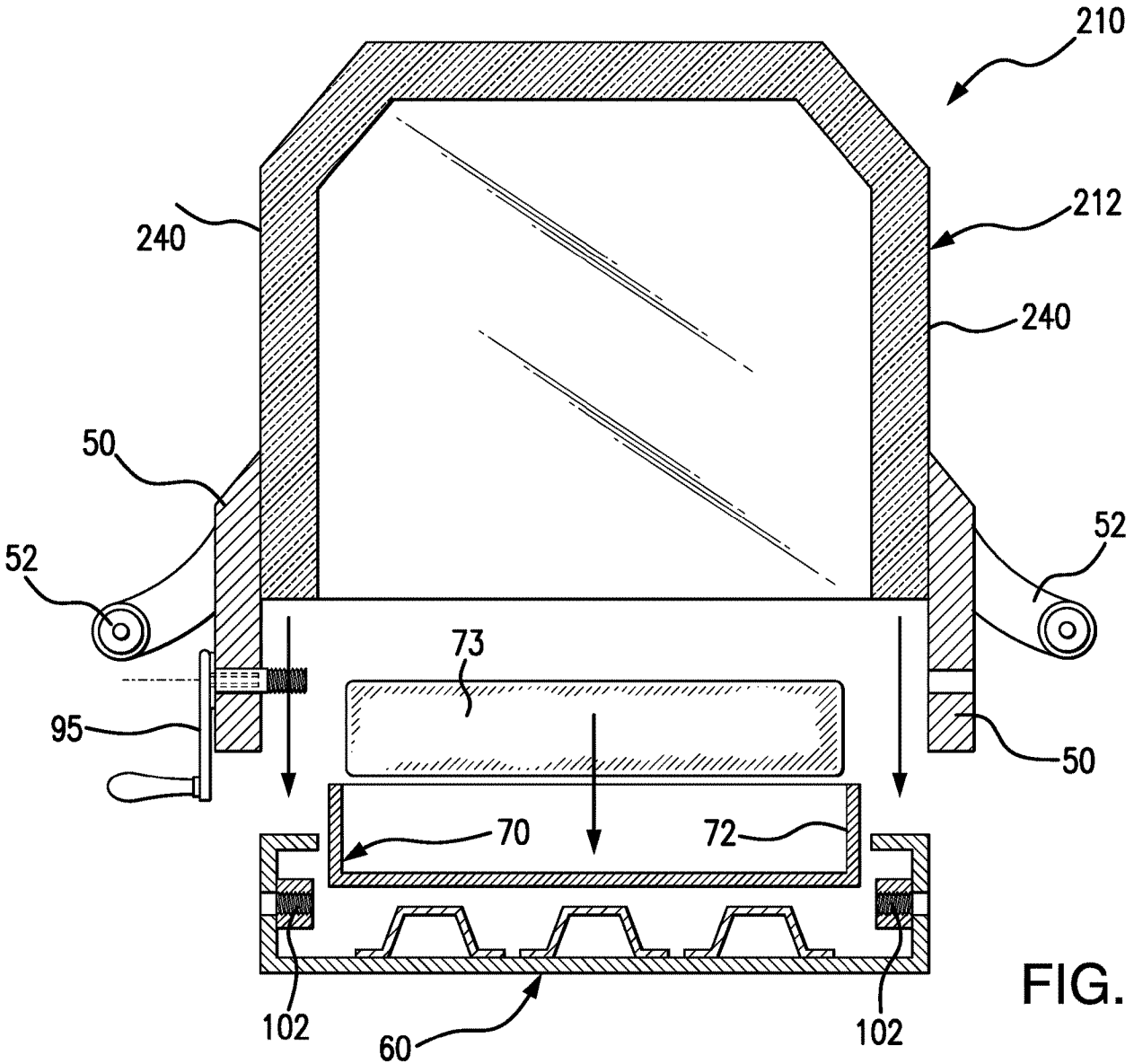
FIG. 15 is an elevational view, shown in cross-section, illustrating the embodiment of FIG. 14 wherein the entire top assembly of the reusable transparent casket is removable from a floor structure as an integral unit.

Referring to FIGS. 14 and 15, a further embodiment of the reusable transparent casket assembly is shown and is generally indicated as 210. The transparent casket assembly 210 includes an upper box structure assembly 212 made as an integral unit including an integral transparent structure 240 and lower side rails 50. The transparent structure 240 includes a transparent top, transparent longitudinal side panels, a transparent head panel and a transparent foot panel. Preferably, the transparent members of the upper assembly 212, including the transparent top, transparent side panels, transparent head panel and transparent foot panel are formed of acrylic and are glued along seams to create a one-piece unit. Similar to the embodiment of FIGS. 7 and 8, the entire upper box structure 212 of the transparent casket is removably attachable to the floor structure 60 using bolts or similar fastening hardware that passes through the lower side walls 50 and into threaded bushings 102 within the floor structure 60. The entire upper box structure 212 is lifted off of the floor structure 60 to allow for ease of placement and removal of the casket insert container 70, along with the deceased body, onto the floor structure 60. In this particular embodiment, the swing bar handles 52 are mounted to the lower side rails 50 for added stability and support.

What is claimed is:

1. A casket assembly comprising:

a vertical side wall box structure having a plurality of panels including opposite longitudinal side panels, a head panel and a foot panel;

a floor structure;

a transparent lid attached to at least one of the plurality of panels of the vertical side wall box structure;

the plurality of panels each including a transparent wall having a top edge, a bottom edge, opposite vertical side edges, an outer surface and an inner surface, and the plurality of panels further including a lower rail attached to the outer surface of the transparent wall and extending down below the bottom edge of the transparent wall;

the plurality of panels, the transparent lid and the floor structure being assembled to enclose a casket interior;

an insert container formed of a material suitable for cremation and being adapted for holding a deceased human body, and the insert container being sized for receipt within the enclosed casket interior; and at least one of the plurality of panels being separable from the floor structure and movable relative to the floor structure to allow horizontal movement of the insert container into and out from the casket interior without lifting the insert container over the top edge of the panels.

2. The casket assembly as recited in claim 1 wherein the vertical side wall box structure is attachable to the floor structure.

3. The casket assembly as recited in claim 2 further comprising a movable locking mechanism for removably securing the vertical side wall box structure to the floor structure.

4. The casket assembly as recited in claim 3 wherein the locking mechanism includes a plurality of locking fingers structured and disposed for movable engagement and disengagement to locking pins for removably securing the vertical side wall box structure to the floor structure.

5. The casket assembly as recited in claim 2 further comprising a plurality of threaded fasteners each structured for engagement within a threaded bushing within the floor structure for removably securing the vertical side wall box structure to the floor structure.

6. The casket assembly as recited in claim 2 wherein the vertical side wall box structure is hingedly attached to the floor structure along one of the plurality of panels.

7. The casket assembly as recited in claim 1 wherein the floor structure includes a top edge extending at least partially about a periphery of the floor structure, and the top edge being structured and disposed to be positioned in confronting opposition to the bottom edge of the transparent wall of at least one of the plurality of panels.

8. The casket assembly as recited in claim 7 further comprising at least one light emitting device on the floor structure for directing light through the transparent wall of the at least one of the plurality of panels when the vertical side wall box structure is positioned on the floor structure.

9. A casket assembly comprising:

an upper box structure having a plurality of panels including opposite longitudinal side panels, a head panel and a foot panel, and further including a transparent top;

a floor structure;

the plurality of panels each including a transparent wall having a top edge, a bottom edge, opposite vertical side edges, an outer surface and an inner surface, and the plurality of panels further including a lower rail attached to the outer surface of the transparent wall and extending down below the bottom edge of the transparent wall;

the plurality of panels, the transparent top and the floor structure being assembled to enclose a casket interior;

an insert container formed of a material suitable for cremation and being adapted for holding a deceased human body, and the insert container being sized for receipt within the enclosed casket interior; and at least one of the plurality of panels being separable from the floor structure and movable relative to the floor structure to allow horizontal movement of the insert container into and out from the casket interior without lifting the insert container over the top edge of the panels.

10. The casket assembly as recited in claim 9 wherein the upper box structure is attachable to the floor structure.

11. The casket assembly as recited in claim 10 further comprising at least one light emitting device on the floor structure for directing light through the transparent wall of the at least one of the plurality of panels when the upper box structure is positioned on the floor structure.

* * * * *